US005364728A

United States Patent [19]

Ohta et al.

[11] Patent Number: 5,364,728

[45] Date of Patent: Nov. 15, 1994

[54] METHOD OF MANUFACTURING A TONER

[75] Inventors: Hideki Ohta, Ikoma; Tatsuo Imafuku, Higashiosaka; Masami Tsujihiro, Katano; Toshiro Tokuno, Takarazuka; Hiroshi Shimoyama; Nobuhiro Hirano, both of Osaka, all of Japan

[73] Assignee: Mita Industrial Co., Ltd., Osaka, Japan

[21] Appl. No.: 996,858

[22] Filed: Dec. 21, 1992

Related U.S. Application Data

[63] Continuation of Ser. No. 619,578, Nov. 29, 1990, abandoned.

[30] Foreign Application Priority Data

Nov. 30, 1989 [JP] Japan ..... 1-312500

[51] Int. Cl.[5] ..... G03G 9/08

[52] U.S. Cl. ..... 430/137; 430/106; 430/109

[58] Field of Search ..... 430/106, 109, 904, 137, 430/110, 106.6

[56] References Cited

U.S. PATENT DOCUMENTS

| | | | |
|---|---|---|---|
| 4,401,742 | 8/1983 | Chiang | 430/137 |
| 4,904,560 | 2/1990 | Yamashiro et al. | 430/137 |
| 4,910,113 | 3/1990 | Mori et al. | 430/106 |

FOREIGN PATENT DOCUMENTS 0278523 8/1988 European Pat. Off. .

OTHER PUBLICATIONS

Pat. Abst. of Jap., vol. 13, No. 1, (P-808) (3349) Jan. 6, 1989 of JP-A-63 210849 (Sep. 1, 1988).

Pat. Abst. of Jap., vol. 8, No. 147 (P-2985) (1584) Jul. 10, 1984 of JP-A-59 45454 (Mar. 14, 1984).

Pat. Abst. of Jap., vol. 12, No. 427 (P-784) (3274) Nov. 11, 1988 of JP-A-63 158566, JP-A-63 158567 (Jul. 1, 1988).

Pat. Abst. of Jap., vol. 12, No. 453 (P-792) (3300) Nov. 29, 1988 of JP-A-63 175869 (Jul. 20, 1988).

Pat. Abst. of Jap., vol. 13, No. 266 (P-887) (3614) Jun. 20, 1989 of JP-A-01 59242 (Mar. 6, 1989).

Pat. Abst. of Jap., vol. 10, No. 111 (P-451) (2168) Apr. 25, 1986 of JP-A-60 243664 (Dec. 3, 1985).

Pat. Abst. of Jap., vol. 5, No. 191 (P-92) (863) Dec. 5, 1981 of JP-A-56 116044 (Sep. 11, 1981).

Pat. Abst. of Jap., vol. 8, No. 219 (P-306) (1656) Oct. 4, 1984 of JP-A-59 102250 (Jun. 13, 1984).

*Primary Examiner*—Marion E. McCamish
*Assistant Examiner*—Rosemary Ashton
*Attorney, Agent, or Firm*—Armstrong, Westerman, Hattori, McLeland & Naughton

[57] ABSTRACT

Spheroidal toner for developing electrostatic images is composed of a binding resin as its main component in which at least carbon black and a dispersion stabilizer for the carbon black are contained, the conductivity of the toner being in the range of $5\times10^{-11}$ to $5\times10^{-9}$ S/cm. The conductivity of the toner is preferably within the range of $4\times10^{-10}$ to $5\times10^{-9}$ S/cm. It is also desirable that the dispersion stabilizer be composed of at least one selected from the group consisting of oil-soluble dyes, coupling agents, and surfactants, and that according to Wadel's practical spheroidicity, the toner be within the range of 0.95 to 1.0. A method of manufacturing the toner includes the steps of: forming grafted carbon black by prepolymerization of a polymerizable composition containing carbon black and a monomer forming a binding resin; adding a carbon black dispersion stabilizer to the prepolymerized composition; and suspending the composition in an aqueous medium and polymerizing the suspended particles in the presence of a polymerization initiator.

8 Claims, No Drawings

METHOD OF MANUFACTURING A TONER

This application is a continuation of application No. 07/619,578 filed Nov. 29, 1990, now abandoned.

BACKGROUND OF THE INVENTION

1. Field of the Invention

The present invention relates to toner used in an image forming apparatus such as an electrophotographic copying machine or the like, and to a method of manufacturing the same. More particularly, the invention relates to toner capable of retaining excellent electrostatic charge characteristics despite changes in temperature, humidity and other environmental conditions, and to a method of manufacturing the same.

2. Description of the Prior Art

In an image forming apparatus such as an electrophotographic copying machine or the like, a two-component developer consisting of particulate toner and magnetic carrier, or other frictionally chargeable materials, is usually used as the developer to make visible by dry development an electrostatic latent image formed on a photoconductor. A typical method of manufacturing the particulate toner used in the two-component developer is as follows: First, a binding resin which is the main component of the toner, and additives such as colorants for conferring desired properties on the toner are melted and mixed together, thereby uniformly dispersing the toner additives. The mixture is then ground by a mill and classified by a classifier to select toner having a prescribed particle size. Since the particle shape is irregular, the toner manufactured by such method generally has a low flowability and is therefore susceptible to blocking.

Usually, carbon black is added to black toner. When toner containing carbon black is manufactured by the above grinding method, since the obtained toner particles have irregular shapes, carbon black often crops out at the fractured surfaces of the toner particles. This causes the resistance of the toner to be partially reduced since carbon black is a conductor. As a result, the charge amount of the toner charged through friction with the carrier is varied resulting in a variation in image density, fogging of the image, and splashing of toner.

To solve the problem with the above grinding method for the manufacturing toner, there has been proposed a method known as the polymerization method wherein a polymerization reaction is performed with carbon black dispersed in a monomer forming the binding resin. With this polymerization method, however, the carbon black tends to flocculate in the monomer, and toner with carbon black uniformly dispersed in the binding resin cannot be obtained by polymerization alone. If the carbon black is not dispersed uniformly, the electrostatic charge characteristics of the toner tends to wander, causing such problems as splashing of toner and fogging of images.

The present invention, which overcomes the above-described problems, makes possible the objects of providing toner having carbon black uniformly dispersed and therefore having stable electrostatic charge characteristics and be capable of producing high-density images without causing splashing of toner and fogging of images, and also providing a method for the manufacturing the same.

SUMMARY OF THE INVENTION

The toner for developing electrostatic images, which overcomes the above-discussed and numerous other disadvantages and deficiencies of the prior art, comprises spheroidal toner for developing electrostatic images, the main component of which is a binding resin in which at least carbon black and a dispersion stabilizer for the carbon black are contained, the conductivity of the toner being in the range of $5\times10^{-11}$ to $5\times10^{-9}$ S/cm.

In a preferred embodiment, the conductivity of the toner is in the range of $4\times10^{-10}$ to $5\times10^{-9}$ S/cm.

In another preferred embodiment, the dispersion stabilizer is composed of at least one selected from the group consisting of oil-soluble dyes, coupling agents and surfactants.

In a further preferred embodiment, the toner is in the range of 0.95 to 1.0 according to Wadel's practical spheroidicity.

A method of manufacturing toner for developing electrostatic images, including the steps of: forming grafted carbon black by prepolymerization of a polymerizable composition containing carbon black and a monomer forming a binding resin; adding a carbon black dispersion stabilizer to the prepolymerized composition; and suspending the composition in an aqueous medium and polymerizing the suspended particles in the presence of a polymerization initiator.

In a preferred embodiment, the mixing percentage of the carbon black is within the range of 2 to 10 percent by weight on the basis of the weight of the monomer.

In another preferred embodiment, the graft rate of the pregrafted carbon black is within the range of 20 to 200%.

In further preferred embodiment, the dispersion stabilizer is composed of at least one selected from the group consisting of oil-soluble dyes, coupling agents, and surfactants.

Thus, the invention herein stated achieves the following objects.

(1) To provide spheroidal toner having a preferred conductivity and excellent electrostatic charge characteristics;

(2) To provide toner capable of stably retaining excellent electrostatic charge characteristics despite changes in temperature, humidity and other environmental conditions, and capable of producing good images;

(3) To provide toner free from such problems as fogging and splashing; and (4) To provide a method of manufacturing the toner having the above-described excellent characteristics.

DESCRIPTION OF THE PREFERRED EMBODIMENTS

The inventors have found a preferred conductivity for spheroidal toner that has excellent electrostatic charge characteristics.

The toner of the present invention has carbon black evenly and uniformly dispersed in a binding resin, the conductivity of the toner being set within a specific range so as to stably maintain the charge amount of the toner.

Since the spheroidal toner whose conductivity is set within the specific range shows a very good flowability, electric charges generated through friction are suitably moderated to provide stable electrostatic charge characteristics. Carbon black has a polar group such as a hydroxyl group, carboxyl group, etc. on its surface and therefore has a poor affinity for monomers forming the binding resin which is lipophilic. This tends to cause the carbon black particles to flocculate with each other. In the present invention, carbon black is prepolymerized in a monomer to form grafted carbon black so as to enable the carbon black to exist in the monomer in a stable condition. The grafted carbon black stays dispersed in the form of fine particles in suspension particles until the polymerization reaction is completed.

When carbon black is prepolymerized so as to achieve a graft rate (the weight percentage of polymer bound to carbon black with respect to the weight of carbon black) of 20 to 200%, grafted carbon black having good dispersibility in monomers can be obtained. When the graft ratio is lower than 20%, sufficient dispersion effects cannot be obtained. On the other hand, when the graft ratio is higher than 200%, the graft polymers of the grafted carbon black are likely to cross-link with each other or to gel, thus deteriorating the dispersibility of the grafted carbon black.

According to the present invention, a dispersion stabilizer composed of one or more items selected from Oil Black (CI 26150), Nigrosine Base (CI 5045) oil-soluble dyes, coupling agents and surfactants, is added to the prepolymer containing carbon black grafted with the above specified graft rate, thereby helping to further enhance the retention of carbon black during the polymerization reaction and in the resulting toner and thus making it possible to obtain toner having the previously mentioned preferred conductivity with good reproducibility.

Also, any known carbon black can be used as the carbon black to be used for the present invention, but commercially available carbon black contains agglomerates having a size ranging from 1 μm to several hundreds μm. Therefore, in the present invention, it is desirable that carbon black be predispersed in a monomer using an ultrasonic disperser, ball mill, homomixer, etc. before grafting. Since the contact areas of the carbon black with the monomer are increased as a result of the predispersion, efficient grafting occurs, thus further enhancing the dispersibility of the carbon black.

It is desirable that carbon black be mixed in 2 to 10 percent by weight with respect to the monomer. If the mixing percentage is higher than 10 percent by weight, the conductivity of the obtained toner tends to become higher than $5\times10^{-9}$ S/cm and the charge amount of the toner therefore tends to drop, leading to splashing of toner and fogging of images. On the contrary, if the percentage is lower than 2 percent by weight, it becomes difficult to adjust the toner conductivity, with carbon black uniformly dispersed therein, to the specified range, which causes the charge amount of the toner to increase and thus the image density to decrease.

The above grafting can be performed by thermal polymerization. For efficient graft polymerization, it is desirable to use an azoic polymerization initiator. As the azoic polymerization initiator, any of known azoic initiators can be used, which include 2,2'-azobis-(2,4'-dimethylvaleronitrile), 2,2'-azobisisobutyronitrile, etc., and the initiator is used in 0.01 to 2 percent by weight with respect to the polymerizable monomer.

The monomers used for the present invention should be capable of radical polymerization and should form polymers having fixing and detecting properties required for the toner. Such monomers include vinyl aromatic monomers, acrylic monomers, vinyl ester monomers, vinyl ether monomers, diolefin monomers, monoolefin monomers, etc.

The vinyl aromatic monomers used are expressed by the following general formula (1).

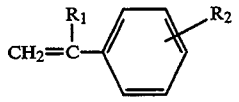

(1)

In the formula, $R_1$ represents a hydrogen atom, a lower alkyl group or a halogen atom, and $R_2$ denotes a hydrogen atom, a lower alkyl group, a halogen atom, an alkoxy group, a nitro group or a vinyl group.

To describe specifically, such monomers include styrene, α-methylstyrene, vinyltoluene, α-chlorostyrene, o-, m-, p-chlorostyrene, p-methylstyrene, and divinylbenzene.

The acrylic monomers used are expressed by the following general formula (2).

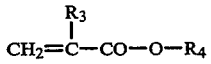

(2)

In the formula, $R_3$ represents a hydrogen atom or a lower alkyl group, and $R_4$ denotes a hydrogen atom, a hydrocarbon radical having 1 to 12 carbon atoms, a hydroxyalkyl group or a vinyl ester group.

To describe specifically, such monomeres include methyl acrylate, ethyl acrylate, butyl acrylate, 2-ethylhexyl acrylate, cyclohexyl acrylate, phenyl acrylate, methyl metacrylate, hexyl methacrylate, 2-ethylhexyl methacrylate, ethyl β-hydroxyacrylate, propyl γ-hydroxyacrylate, butyl δ-hydroxyacrylate, ethyl β-hydroxyacrylate, ethylene glycol dimethacrylate, tetraethylene glycol dimethacrylate, etc.

The vinyl ester monomers used are expressed by the following general formula (3).

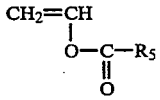

(3)

In the formula, $R_5$ represents a hydrogen atom or a lower alkyl group.

To describe specifically, such monomers include vinyl formate, vinyl acetate, vinyl propionate, etc.

The vinyl ether monomers used are expressed by the following general formula (4).

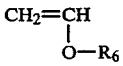

(4)

In the formula, $R_6$ represents a hydrocarbon radical having 1 to 12 carbon atoms.

To describe specifically, such monomers include vinyl-n-butylether, vinylphenylether, vinylcyclohexylether, etc.

The diolefin monomers used are expressed by the following general formula (5).

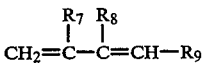

(5)

In the formula, $R_7$, $R_8$, and $R_9$ respectively represent a hydrogen atom, a lower alkyl group or a halogen atom.

To describe specifically, such monomers include butadiene, isoprene, chloroprene, etc.

The monoolefin monomers used are expressed by the following general formula (6).

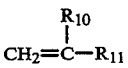

(6)

In the formula, $R_{10}$ and $R_{11}$ respectively represent a hydrogen atom or a lower alkyl group.

To describe specifically, such monomers include ethylene, propylene, isobutylene, butene-1, pentene-1, 4-methylpentene, etc.

Either one, or a combination of two or more kinds of the above-mentioned monomers can be used, but from the viewpoint of the fixing properties, it is desirable that at least one kind of monomer be selected which consists mainly of styrene, acrylic ester and methacrylic ester.

After grafting the carbon black, a carbon black dispersion stabilizer is added to the prepolymer composition containing the grafted carbon black. For the carbon black dispersion stabilizer, one kind or two or more selected from Oil Black (CI 26150), Nigrosine Base (CI 5045) oil-soluble dyes, coupling agents such as aluminum, titan, etc., and surfactants are used, as previously mentioned. The dispersion stabilizer should be added in 0.1 to 10 percent by weight with respect to carbon black.

The above mixture is then suspended in an aqueous medium. At this time, known additives containing properties preferred for conference on the toner may be added to the aqueous medium.

Next, a polymerizable monomer and other toner additives are added to the polymer containing the carbon black, to prepare a polymerizable composition for suspension polymerization. The additives used include a polymerization initiator, a charge control agent for improving the charge characteristics of the toner, a mold release agent for conferring offset preventing effect on the toner, etc. The charge control agents used include Nigrosine Base (CI 5045), Oil Black (CI 26150), Spiron Black and other oil-soluble dyes; metal naphthenates; fatty acid metal soap; resin acid soap; and others. The mold release agents used include low molecular polyethylene, low molecular polypropylen, various waxes, silicone oil. These additives should preferably be added in 0.1 to 10 parts by weight for every 100 parts by weight of the monomer.

The above-described initiator includes azo compounds such as azobisisobutyronitrile and oil-soluble initiator such as cumene hydroperoxide, t-butylhydroperoxide, dicumylhydroperoxide, di-t-butylhydroperoxide, benzoyl peroxide, and lauroyl peroxide.

The ratio of the monomer to water can be varied over a wide range but should generally be within the range of 1:99 to 50:50 by weight, and preferably within the range of 5:95 to 30:70. The mixing ratio of the polymerization initiator should be determined as considered appropriate as a catalyst. Generally, 0.1 to 10 percent by weight is desirable with respect to the monomer charged. The polymerization initiating temperature should generally be 40° to 100° C., and preferably 50° to 90° C., as in the case of conventional suspension polymerization. The polymerization time varies depending on the kind of monomer used, but should be selected between 2 to 20 hours according to whatever time is necessary to complete the polymerization. The resulting polymer after reaction is filtered to separate solids from liquid, and the thus separated polymer is washed and treated with dilute acid, etc. to obtain the toner of the present invention.

According to the above manufacturing method, spheroidal toner having a conductivity of $5\times10^{-9}$ to $5\times10^{-11}$ S/cm is obtained. The toner whose conductivity is within the above range is provided with excellent electrostatic charge characteristics. Spheroidal toner having a conductivity of $4\times10^{-10}$ to $5\times10^{-9}$ S/cm exhibits further enhanced charge characteristics. When the conductivity of the spheroidal toner is higher than $5\times10^{-9}$ S/cm, splashing of toner and fogging of images will result because of insufficient charging of the toner. When the conductivity of the spheroidal toner is lower than $5\times10^{-11}$ S/cm, the image density will decrease because of a highly increased charge amount of the toner.

It is further desirable that the toner be nearly spherical as in Wadel's practical spheroidicity of 0.95 to 1.0, and have a conductivity of $5\times10^{-9}$ to $5\times10^{-11}$ S/cm, since the flowability of such toner is extremely stable and therefore the variation in the charge amount of toner is kept within an extremely narrow range.

EXAMPLES

The present invention will be described in detail with reference to examples.

EXAMPLE 1

Grafting of Carbon Black

A composition consisting of 5 parts by weight of carbon black MA-100 (Brand name of Mitsubishi Kasei), 40 parts by weight of styrene, and 0.2 parts by weight of polymerization initiator ADVN was polymerized for 1.5 hours at 70° C. for grafting. The polymerization rate was 25%, and the graft rate was 70%.

Further, to the resultant compound was added 0.25 parts by weight of a carbon black dispersion stabilizer "Oil Black HBB" (Brand name of Orient Chemical).

(Suspension Polymerization)

To the above compound there were added 40 parts by weight of styrene, 0.7 parts by weight of divinylbenzene as a crosslinking agent, 1 part by weight of "Spiron Black TRH" as a charge control agent (Brand name of Orient Chemical), and 20 parts by weight of 2-ethylhexyl methacrylate, which were adequately mixed using a ball mill. To this mixture was added 5 parts by weight of polymerization initiator AIBN. The mixture was then put into an aqueous phase consisting of 400 parts by weight of water, 6 parts by weight of tribasic calcium phosphate, and 0.05 parts by weight of dodecyl-sodium benzensulfonic acid, the mixture being stirred for 10 minutes by a TK homomixer at 10000 rpm for dispersion and suspension in the aqueous phase. The thus prepared mixture was polymerized for 10 hours at 80° C. until the reaction was completed. The resultant polymer was filtered, washed, and dried to obtain toner. The conductivity of the toner measured $7\times10^{-10}$ S/cm.

The toner was mixed with ferrite carrier with the toner density adjusted to 3%, to prepare a two-component developer. The thus prepared developer was subjected to copying tests on an electrophotographic copying machine DC-1205 (Model name of Mira Industrial Co., Ltd. ). As a result of the tests, high-density, clear images were stably obtained without causing splashing of toner or fogging of images.

EXAMPLE 2

Toner was manufactured in the same manner as in Example 1, except that 0.25 parts by weight of an aluminum coupling agent AL-M (Brand name of Ajinomoto) was used as the carbon black dispersion stabilizer. The conductivity of the resultant toner measured $6\times10^{-10}$ S/cm.

Using the toner, a developer was prepared in the same manner as in Example 1 and subjected to image producing tests. As a result of the tests, high-density, clear images were stably obtained without causing splashing of toner or fogging of images.

COMPARATIVE EXAMPLE 1

Toner was manufactured in the same manner as in Example 1, except that the carbon black dispersion stabilizer was not added. In the resultant toner, there was noted flocculation of carbon black. The conductivity of the toner measured $6.2\times10^{-9}$ S/cm, but since there were many toner particles not sufficiently charged, fogging was noted as a result of image producing tests.

COMPARATIVE EXAMPLE 2

Toner was manufactured in the same manner as in Example 1, except that the amount of carbon black was changed to 2 parts by weight. The conductivity of the resultant toner measured $4\times10^{-11}$ S/cm. Using the toner, a developer was prepared in the same manner as in Example 1 and subjected to image producing tests. As a result of the tests, there was not much splashing or fogging, but it was only possible to obtain low-density images.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method of manufacturing toner for developing electrostatic images, the toner containing a binding resin, carbon black dispersed in the binding resin and a dispersion stabilizer for the carbon black, comprising:

(a) forming a grafted carbon black with a graft rate of 20 to 200% by prepolymerizing the carbon black and a first portion of a polymerizable monomer constituting the binding resin in the presence of an azoic polymerization initiator the carbon black being present within the range of 2 to 10% by weight on the basis of the weight of polymerizable monomer;

(b) stirring a composition containing the grafted carbon black and an oil-soluble dye as the dispersion stabilizer of carbon black to disperse the grafted carbon black in the form of fine particles, the dispersion stabilizer being present in a ratio of 0.1 to 10% by weight per gram of the carbon black; and (c) suspending and polymerizing a mixture of the composition, a second portion of the polymerizable monomer constituting the binding resin and a second polymerization initiator in an aqueous medium, wherein the resultant toner has a conductivity of $5\times10^{-11}$ to $5\times10^{-9}$ S/cm.

2. A method of manufacturing toner for developing electrostatic images according to claim 1, wherein the azoic polymerization initiator is selected from the group consisting of 2,2'-azobis-(2,4'-dimethylvaleronitrile) and 2,2'-azobisisobutyronitrile.

3. A method of manufacturing toner for developing electrostatic images according to claim 1, wherein step (a) includes 0.01 to 2% by weight azoic polymerization initiator based on the total weight of the monomer in step (a).

4. A method of manufacturing toner for developing electrostatic images according to claim 1, wherein the polymerization initiator used in step (c) is oil-soluble.

5. A method of manufacturing toner for developing electrostatic images according to claim 1, wherein the second polymerization initiator is an azoic polymerization initiator.

6. A method of manufacturing toner for developing electrostatic images according to claim 1, wherein step (c) includes a weight ratio range of the polymerizable monomer to the water of 1:99 to 50:50.

7. A method of manufacturing toner for developing electrostatic images according to claim 1, wherein step (c) includes a weight ratio range of the polymerizable monomer to the water of 5:95 to 30:70.

8. A method of manufacturing toner for developing electrostatic images according to claim 1, wherein the mixture in step (c) further comprises tribasic calcium phosphate and dodecyl-sodium benzenesulfonic acid.

* * * * *